US005376038A

United States Patent [19]

Arad et al.

[11] Patent Number: 5,376,038

[45] Date of Patent: Dec. 27, 1994

[54] DOLL WITH PROGRAMMABLE SPEECH ACTIVATED BY PRESSURE ON PARTICULAR PARTS OF HEAD AND BODY

[75] Inventors: Avi Arad, Westport, Conn.; Robert W. Jeffway, Jr., Leeds, Mass.

[73] Assignee: Toy Biz, Inc., New York, N.Y.

[21] Appl. No.: 183,597

[22] Filed: Jan. 18, 1994

[51] Int. Cl.[5] ..... A63H 3/28; A63H 3/52

[52] U.S. Cl. ..... 446/297; 446/302; 446/408

[58] Field of Search ..... 446/297, 299, 300, 302, 446/303, 370, 371, 397, 408, 484

[56] References Cited

U.S. PATENT DOCUMENTS

| | | | |
|---|---|---|---|
| 3,755,960 | 9/1973 | Tepper et al. | 446/299 |
| 3,977,292 | 8/1976 | Favilli et al. | 446/297 X |
| 4,237,647 | 12/1980 | Shaw | 446/303 |
| 4,249,338 | 2/1981 | Wexler | 446/297 X |
| 4,451,911 | 5/1984 | Klose et al. | 446/303 X |
| 4,820,236 | 4/1989 | Berliner et al. | 446/484 X |
| 4,857,030 | 8/1989 | Rose | 446/303 |
| 4,923,428 | 5/1990 | Curran | 446/299 X |
| 5,145,447 | 9/1992 | Goldfarb | 446/397 X |

FOREIGN PATENT DOCUMENTS 0549840 7/1993 European Pat. Off. ..... 446/297

*Primary Examiner*—Max Hindenburg
*Assistant Examiner*—D. Neal Muir
*Attorney, Agent, or Firm*—Morey B. Wildes

[57] ABSTRACT

This invention relates to talking dolls of the type having internal prerecorded speech mechanisms. More particularly, the present invention relates to talking dolls of the type having internal prerecorded speech mechanisms, wherein the doll's educational speech is activated by pressing on certain parts of the doll's body and head region. Still more particularly, the present invention relates to talking dolls of the type having internal prerecorded speech mechanisms, wherein the doll's educational speech can be programmed by the user to play phrases in a desired sequence. Still more particularly, the present invention relates to talking dolls of the type having internal prerecorded speech mechanisms, wherein the doll's educational speech is programmed to advance with the child user and to educate the child user as to the names and functions of the different body parts.

5 Claims, 5 Drawing Sheets

DOLL WITH PROGRAMMABLE SPEECH ACTIVATED BY PRESSURE ON PARTICULAR PARTS OF HEAD AND BODY

BACKGROUND OF THE INVENTION

This invention relates to talking dolls of the type having internal prerecorded speech mechanisms. More particularly, the present invention relates to talking dolls of the type having internal prerecorded speech mechanisms, wherein the doll's educational speech is activated by pressing on certain parts of the doll's body and head region. Still more particularly, the present invention relates to talking dolls of the type having internal prerecorded speech mechanisms, wherein the doll's educational speech can be programmed by the user to play phrases in a desired sequence. Still more particularly, the present invention relates to talking dolls of the type having internal prerecorded speech mechanisms, wherein the doll's educational speech is programmed to advance with the child user and to educate the child user as to the names and functions of the different body parts.

Prior art versions of dolls having prerecorded speech involved the use of magnetic audio tape or phonograph records as the speech mechanisms within the dolls for playing the prerecorded speech. These speech mechanisms played by way of mechanical means within the dolls. However, a doll is by nature a toy and an object to be played with by children and, as a result, is often subject to much jarring and turbulent motion. It was found that, unfortunately, the mechanical speech mechanisms of the prior art talking dolls did not hold up well against physical use by children. The often-violent movements caused the mechanical speech systems to be damaged and affected the quality of the doll's speech.

In addition, those prior art talking dolls that use magnetic audio tape or phonograph records as the mechanisms within the dolls for playing the prerecorded speech are limited with regard to speech playback. In a prior art device capable of playing several speech phrases, the phrases are prerecorded in a particular, predetermined order, and a user could play a second phrase only after a first phrase has completed playing. Also, it is often the case in the prior art talking dolls that all the phrases must be played from beginning to end in the exact sequence in which they are prerecorded onto the doll's speech mechanism. These talking dolls do not have the capacity for random access, i.e., the ability to access any particular speech phrase out of sequence or while another speech phrase is playing. Furthermore, none of the prior art talking dolls capable of playing several speech phrases is capable of being preprogrammed by a user so that it will play a sequence of more than one speech phrase without the user having to press any activation buttons between spoken phrases, i.e., they have no "memory" capacity. Thus, a child user could not use such prior art talking dolls to play educational "follow me" games, in which the child learns the words or phrases by repeating the user-programmed sequence of speech phases played by the doll. Also, such dolls that employed internal speech mechanisms to identify different body parts did not employ the speech mechanisms in such a way as to enable the doll to "grow" with the child user. In other words, whereas the prior art dolls occasionally provided speech that identifies a particular body part upon activation of that body part, these dolls did not provide more advanced speech for those same body parts to enable the child user to learn more from the doll even after the child has learned identification of the body parts.

Moreover, none of the prior art dolls have the ability to effectively provide more than one speech-activating switch within the head and face region of the talking doll in order to activate speech relating to more than one head and face region part. The reason for this is that pressing on one area of the head or face often activated more than one of the several speech-activating switches on the head and face region or activated an unintended one of those switches; none of the prior art dolls effectively enabled each head or face region switch to play only the associated prerecorded speech phrase.

The following prior art dolls provide prerecorded speech through the use of switches within or on various parts of the dolls' bodies for activating the speech mechanisms. For example, U.S. Pat. No. 4,950,200 (Curran) discloses a doll that plays phrases of speech off of an internal two-track magnetic audio tape, wherein the speech could be played either in a normal tone and volume off the first audio tape track or in a whisper tone and volume off the second audio tape track, depending on activation of either of two switches, one on the doll heart and another on the doll hand. Consistent with the deficiencies of the prior art dolls mentioned above, the phrases of speech on each of the audio tape tracks of the Curran patent are in a predetermined order and may not be played out of that order. Similarly, U.S. Pat. No. 3,755,960 (Tepper et al.) discloses a doll that produces spoken expressions played off of an internal phonograph that is activated by movement of one of the doll's appendages (arms, legs or head) or by pushing of the doll's belly-button. Also, U.S. Pat. No. 4,451,911 (Klose et al.) discloses a doll that plays vocal messages off of an internal phonograph that is actuated by pushing buttons on different places of the doll's body. As stated above, none of the prior art dolls reflected by these patents discloses any ability to allow a user to program the doll or the speech mechanisms so as to play more than one expression in a desired sequence off of a "memory."

Furthermore, neither Curran nor Tepper et al. discloses a talking doll that produces speech when a portion of the doll's face is touched. Although Klose et al. shows a mouth switch that, when pressed, activates the speech playing mechanism, the prior art dolls all lack the ability to provide for multiple switches within the head and face regions of the talking doll so that pressing on one area of the head or face activates only the associated switch to play the associated prerecorded speech phrase.

It is desirable to provide a talking doll of the type having an internal prerecorded speech mechanism that plays a different speech phrase upon the activation of a switch at each of several different places within the doll's body or head region.

It is also desirable to provide a talking doll of the type having an internal prerecorded speech mechanism that plays several different speech phrases for the same place within the doll's body or head region.

It is similarly desirable to provide a talking doll of the type having an internal prerecorded speech mechanism that allows the speech phrases to be randomly accessed by the user at any time during the playing of a previous speech phrase.

It is further desirable to provide a talking doll of the type having an internal prerecorded speech mechanism that allows the doll to be programmed by a user so that a sequence of speech phrases may be played in any order determined by the user.

It is even further desirable to provide a talking doll of the type having an internal prerecorded speech mechanism that enables the doll and its prerecorded speech to advance with the child user to more advanced speech.

It is still further desirable to provide a talking doll of the type having internal prerecorded speech mechanisms and having multiple switches within the doll's head and face region, wherein each switch is associated with a different prerecorded speech phrase within the speech mechanism and is arranged such that each of the switches in the head region can be activated without unintentionally activating any of the others.

It is yet further desirable to provide a talking doll of the type having an internal prerecorded speech mechanism, wherein the speech mechanisms are less likely to be damaged when the doll is played with by children.

SUMMARY OF THE INVENTION

It is an object of this invention to provide a talking doll of the type having an internal prerecorded speech mechanisms, which doll can be played with by children without damaging the speech mechanisms within.

It is also an object of this invention to provide a talking doll of the type having an internal prerecorded speech mechanism that plays a different speech phrase upon the activation of a switch at each of several different places within the doll's body and head region.

It is another object of this invention to provide a talking doll of the type having an internal prerecorded speech mechanism that plays different speech phrases for the same place within the doll's body or head region.

It is yet another object of this invention to provide a talking doll of the type having an internal prerecorded speech mechanism that allows the speech phrases to be randomly accessed by the user at any time during the playing of a previous speech phrase.

It is a further object of this invention to provide a talking doll of the type having an internal prerecorded speech mechanism that allows the doll to be programmed by a user so that a sequence of speech phrases may be played in an order determined by the user.

It is an even further object of this invention to provide a talking doll of the type having an internal prerecorded speech mechanism that enables the doll and its prerecorded speech to advance with the child user to more advanced speech.

It is still a further object of this invention to provide a talking doll of the type having an internal prerecorded speech mechanism and having multiple switches within the doll's head and face region, wherein each switch is associated with a different prerecorded speech phrase within the speech mechanism and is arranged such that each of the switches in the head region can be activated without accidentally activating any of the others.

These and other objects of the invention are accomplished by providing a talking doll having within it a speech mechanism comprising a microprocessor/-speech synthesizer computer chip that contains thereon several prerecorded educational speech phrases and which is activated by electro-mechanical speech-activating switches that are placed under the doll's outer skin at various places, called contact points, on the doll's body and head region, each of which speech-activating switches activates the speech chip to play a different one of the several prerecorded educational speech phrases for one of two educational levels through a speaker mounted within the doll's body. The talking doll is structured so that activation of a speech-activating switch on one area of the doll will immediately turn the power on and play the educational speech phrase on the portion of the chip associated with the area of the doll's body or head region around the switch activated and with the particular level of play. The speech phrase will play even if another speech phrase is currently playing, i.e., it will supersede the earlier speech phrase, or even if the portion of the chip associated with the new speech phrase to be played is remotely located on the chip from the portion of the chip associated with the speech phrase currently playing. The doll is further equipped with two educational levels of prerecorded speech, a first level that allows the child to learn identification of the specific body parts and a second, more advanced, level that allows the doll to grow with the child to learn the functional applications of the specific body parts. The talking doll is further equipped with a memory capability that, when the doll is set into the programming mode, allows several speech-activating switches to be consecutively activated and temporarily stores the speech information for the speech-activating switches that were activated, so that the speech chip will a short time later play back the prerecorded educational speech phrases associated with each of the activated switches in the exact order in which the switches were activated. The speech-activating switches are set beneath the doll's skin of various parts of the doll body and, especially for the mechanical switches within the doll's head region, are set such that activating one switch by pressing onto the area around the speech-activating switch will not activate any other nearby speech-activating switch in the head region.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
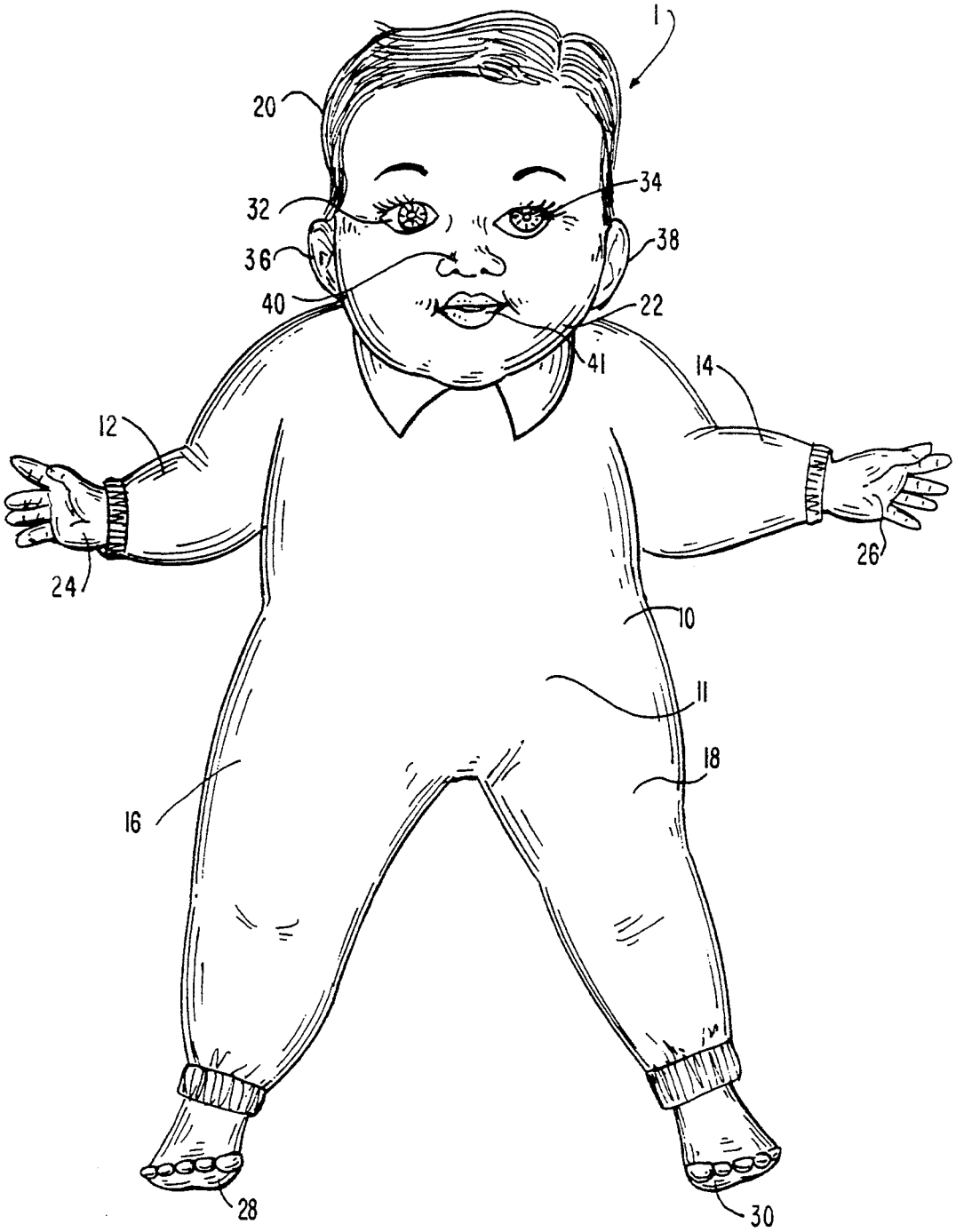
FIG. 1 shows a perspective view of a talking doll of the present invention.

In an embodiment of the present invention, illustrated in FIG. 1, the doll 1 is in the form of a human infant having a body 10, in the middle of which is the belly 11 and to which arms 12,14 and legs 16,18 and a head 20 are connected. The head 20 is connected to the body by way of a neck 22. At the ends of the arms 12,14 are hands 24,26, and at the ends of the legs 16,18 are feet 28,30. On the head 20 region, the doll has eyes 32,34, ears 36,38, a nose 40 and a mouth 41. Not shown in FIG. 1 are the speech mechanism parts of the present invention, e.g., the electro-mechanically activated switches that activate the speech mechanisms, the microprocessor that runs the speech programs and stores the speech data, the mechanism that reproduces the speech data signals and feeds them to the speaker, and the speaker mechanism that plays the speech phrases.

The internal mechanisms of the doll may be covered by any of the conventional materials used for stuffing and covering dolls. The outer surfaces or "skin" of the head 20, hands 24,26 and feet 28,30 should preferably be made from a suitable, flesh-colored flexible polymeric material, such as polyurethane or polyvinyl polymer or co-polymer, and the body 10, arms 12,14 and legs 16,18 should preferably be stuffed with a non-flammable, polymeric fiber-fill material, such as a spun or cut polycarbonate. The material that comprises the outer surface or "skin" of head 20 of doll 1 is made of a flesh-colored, semi-rigid polymeric material, preferably rotocast soft polyvinyl chloride (commonly known as "PVC") and is set around an injection-molded head frame 42 preferably made from any commercially available, non-toxic rigid polymer such as, for example, acrylic butylstyrene (known as "ABS").

Figure 2:
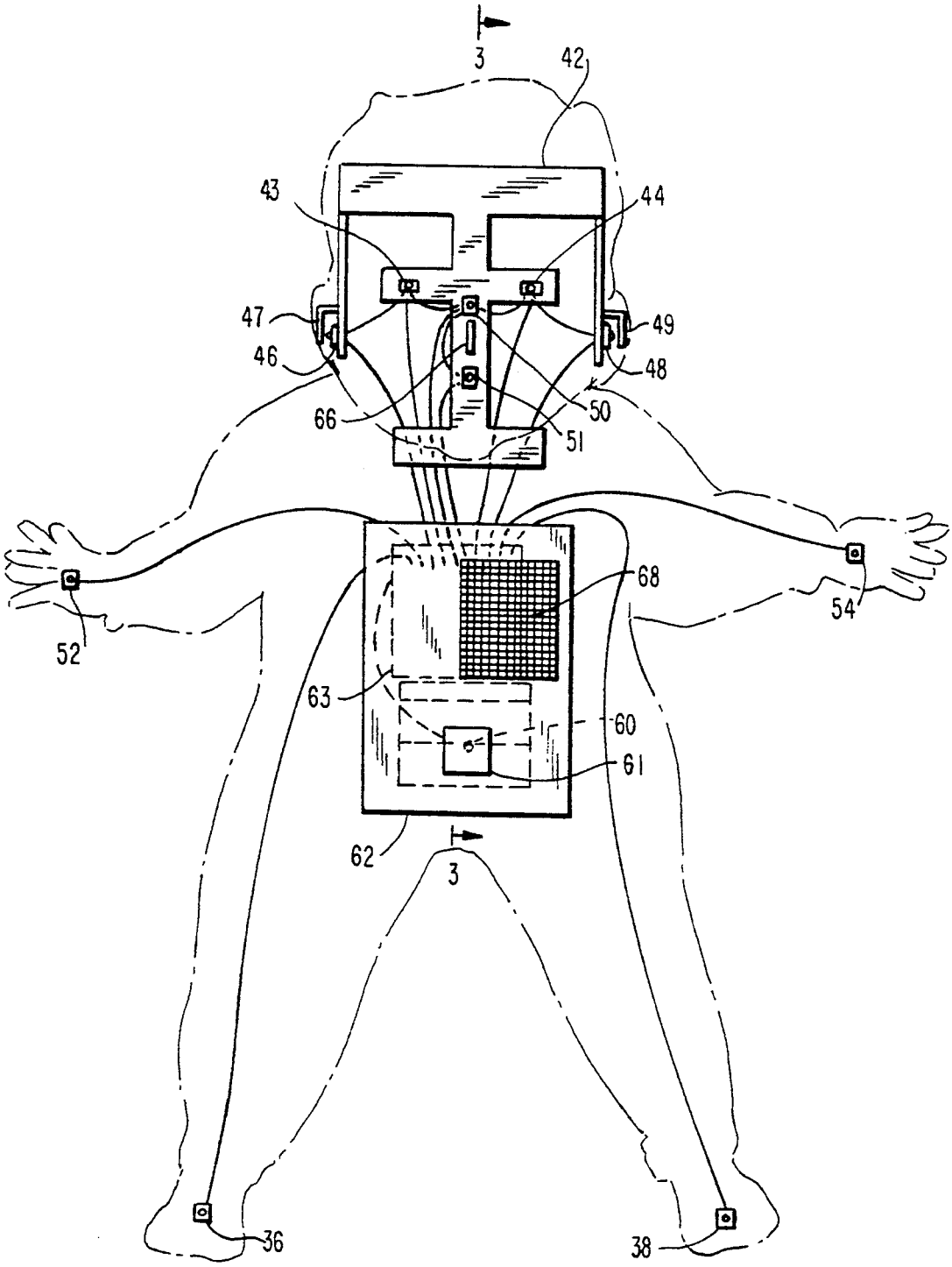
FIG. 2 shows a fragmentary front elevational view of the doll of FIG. 1 with the outer skin and coverings removed.

Within various parts of the doll 1 are electro-mechanically activated speech-activating switches that are set beneath the doll's skin. FIG. 2 shows a cutaway version of FIG. 1 revealing the placement of the electro-mechanical speech-activating switches and the speech mechanisms. The speech-activating switches that activate the playing of educational speech phrases appropriate for the head region are set at various places in the head frame 42, as shown in FIG. 2. For example, speech-activating switches 43,44 for playing speech phrases appropriate to the eye are situated within a section of the head frame 42 directly beneath the eyes 32,34, respectively, of the doll 1. Also, speech-activating switches 46,48 for playing speech phrases appropriate to the ear are situated within a section of the head frame 42 directly beneath the ears 36,38, respectively, of the doll 1. Similarly, speech-activating switches 50 and 51 for playing speech phrases appropriate to the nose and mouth, respectively, are situated within sections of the head frame 42 directly beneath the nose 40 and mouth 41, respectively. Likewise, as further shown in FIG. 2, speech-activating switches 52, 54 for playing speech phrases appropriate to the hands are set within the material that comprises the hands 24,26, respectively, of the doll 1. Speech activating switches 56,58 for playing speech phrases appropriate to the feet are set within the material that comprises the feet 28,30, respectively, of the doll 1. Speech-activating switch 60 for playing speech phrases appropriate to the belly is situated upon control box 62 and is set within the stuffing material that comprises the belly region 11 of body 10.

Each of the speech-activating switches may be one of many electro-mechanical switches in the art of electrical switches but is preferably of the push-button momentary-type switch. Using momentary-type switches for speech activation enables each switch to be activated by only momentary pressure and then immediately deactivated, without requiring sustained pressure on the switch. Also, because the vinyl "skin" on some areas of the doll 1 may not be easily deformed by a user's touch and because the electro-mechanical speech-activating switch may thus not be activated by pressure by a child on an area of skin not precisely covering the speech-activating switch, a spring-mounted switch cap, having a surface area greater than that of the switch, is provided as a cover to each of the electro-mechanical speech-activating switches under the ears 36,38 and belly 11. Specifically, electro-mechanical speech-activating switches 46,48 under the ears 36,38, respectively, are covered by switch caps 47,49, respectively, and electro-mechanical speech-activating switch 60 in the belly 11 is covered by switch cap 61. The switch caps serve to broaden the area of skin covering a particular electro-mechanical switch that will result in activation of the switch. In this way, pressure on an area of skin not precisely covering any of the electro-mechanical speech-activating switches 46,48,60 will deform some immediately nearby area of the skin and cause the nearby spring-mounted switch cap 47,49,61 beneath the skin to be pressed on some portion of its surface and activate the electro-mechanical switch covered thereby.

A problem that had plagued prior art talking dolls and prevented them from having more than one speech-activating switch in the head region or from having speech-activating switches in close proximity to each other is due to the vinyl skin on the head region of the doll not being easily deformed by a user's touch. Because the vinyl skin surrounding the head region must be relatively rigid in order to protect the mechanical devices inside, it is fairly stiff and not easily deformable. Therefore, pressure by a user to the region of skin surrounding one switch often resulted in the activation of a different switch than the one intended or resulted in the activation of more than one switch. This problem was especially acute in the nose/mouth region, where the mechanical switches for the nose and mouth are by nature in close proximity. In order to solve this problem, the present invention provides a protrusion 66 on the head frame 42 of the doll 1 between the electro-mechanical switch 50 situated beneath the skin of the nose 40 and the electro-mechanical switch 51 situated beneath the skin of the mouth 41. This protrusion 66 protects the electro-mechanical switches 50 and 51 from unintended activation by preventing stray or unintended deformations of the vinyl skin of the head 20 from pressing onto those switches. Thus, when the user applies pressure to either the nose 40 or the mouth 41, stray deformations of the skin will press upon the protrusion 66 between the electro-mechanical switches 50 and 51, rather than onto the electro-mechanical switch beneath the other of nose 40 or mouth 41 to which pressure was not applied.

Each of the speech-activating switches is connected through a wire to an assembly having the following functions: microcontroller, speech synthesizer, speech ROM, program ROM, data RAM, and oscillator. This assembly, which is capable of allowing the doll to operate at each of up to three levels, is mounted on a printed electronic circuit board ("PCB") 63, which in turn is mounted within control box 62. The assembly preferably comprises a single integrated chip (IC), and any commercially available IC having the aforementioned functions could be used. An example of such a commercially available IC is a TSP50C04 speech chip/microprocessor manufactured by Texas Instruments, Inc. of Dallas, Tex., which can be custom-manufactured with digitized prerecorded speech data and program software data in ROM (read-only memory). The microprocessor is also equipped with a memory buffer for temporary storage of the desired sequence of phrases during the Level III programming operation.

Figure 3:
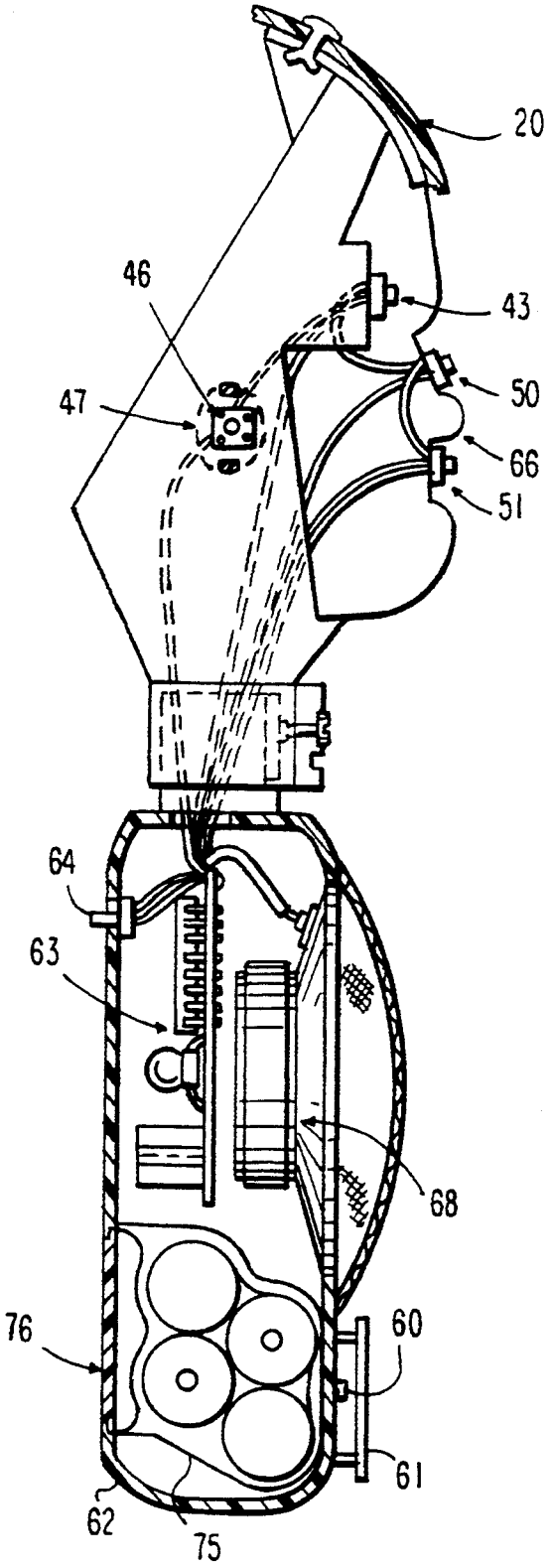
FIG. 3 is a fragmentary cross-sectional view of the doll shown in FIG. 2 taken along line 3—3.
Figure 5:
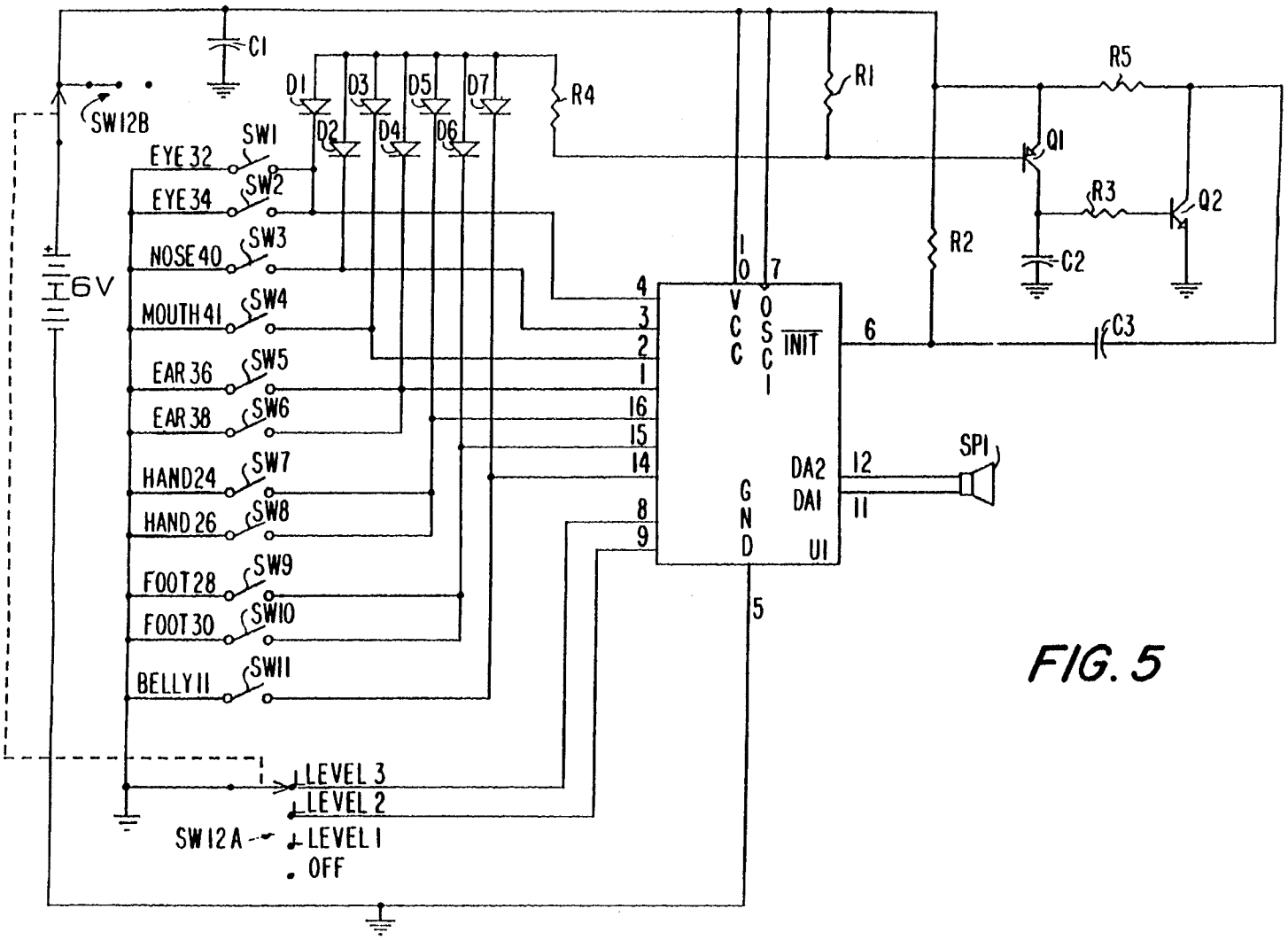
FIG. 5 is a schematic wiring diagram of a representative computerized control for a computer chip of the speech mechanism, according to the invention.

The schematic wiring diagram for the PCB 63 is shown in FIG. 5. Referring to FIGS. 2 and 3, control box 62 is set within the body 10 of doll 1 and is surrounded with fiberfill stuffing (not shown) to prevent damage to the control box 62 by jarring or other violent motions and to insulate the control box 62 from extreme temperatures. Mounted within the control box and facing toward the front of the doll 1 is a small speaker 68, preferably one that is 2¼ inches in size and preferably 32 Ohm and 0.5 Watt. A battery pack 75 containing places for several batteries for powering the doll 1 is removably mounted within the control box 62, at the back of which is a door 76 for user access to the batteries. Also, as discussed, electro-mechanical speech-activating switch 60 for playing speech phrases appropriate to the belly is situated upon the control box 62 so that it does not move from its proper position. Set on the back side of the control box 62 is a slide switch 64 that allows the user to change the speech mode between Level I (identification mode), Level II (speech mode) and Level III (programmable identification mode). In addition, because the electronic "power up" and automatic shut-off features, discussed below, enable the doll 1 and its internal circuitry to be normally powered-off and to be powered-on only from the time a speech-activating switch is pressed until the time the associated speech has completed playing, the physical movement of a switch from the "on" position to the "off" position and back again is rendered unnecessary.

The speech chip within the control circuits of the speech mechanism is embedded with certain data that comprises prerecorded educational speech phrases that have been digitized, processed and synthesized. The educational phrases are arranged in pairs, each pair being associated with a different one of the doll's several body and head region parts, as discussed above. For each doll body and head part, namely, the hands, feet, belly, eyes, ears, nose and mouth, a first prerecorded phrase identifies that doll body part and a second prerecorded phrase involves a function normally associated with that doll body part. The identification speech phrases are played when the doll is set in the identification mode (Level I), and the function speech phrases are played when the doll is set in the speech mode (Level II). The prerecorded speech may be as follows:

| Switch Location | Level I Speech | Level II Speech |
|---|---|---|
| Right Hand | "Hand" | "Hold my hand." |
| Left Hand | "Hand" | "Hold my hand." |
| Right Foot | "Foot" | "Tickle my foot." |
| Left Foot | "Foot" | "Tickle my foot." |
| Belly | "Tummy" | Giggle sound |
| Right Eye | "Eye" | "I see you." |
| Left Eye | "Eye" | "I see you." |
| Right Ear | "Ear" | "I hear you." |
| Left Ear | "Ear" | "I hear you." |
| Nose | "Nose" | "Smells good!" |
| Mouth | "Mouth" | "Let's sing!" |

Figure 4:
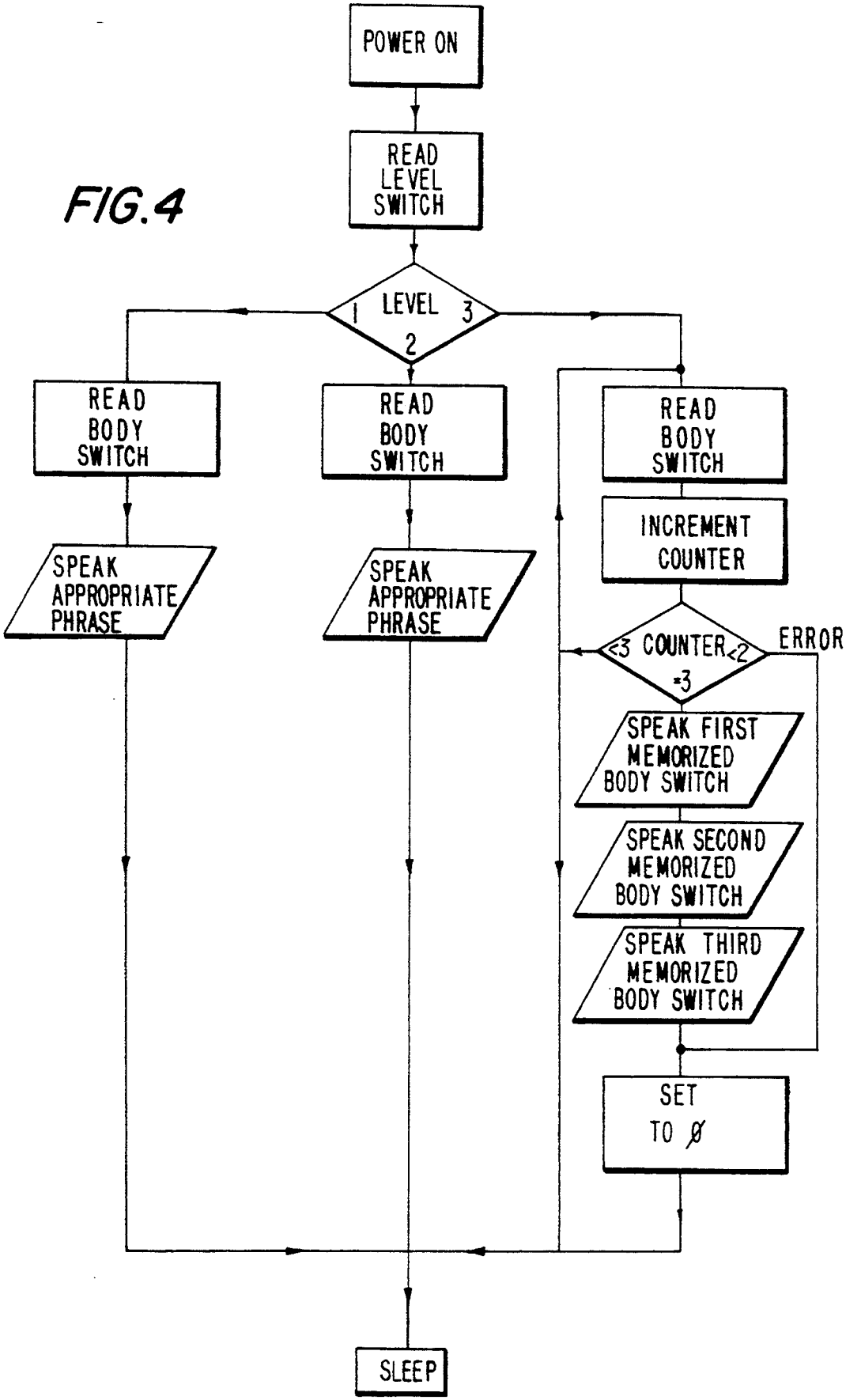
FIG. 4 is a flow chart diagram describing an embodiment of program flow and speech output according to the invention.

When the doll is set to programmable identification mode (Level III), a series of identification speech phrases is played in the sequence in which the associated body parts were pressed. A diagram reflecting an embodiment of program flow and speech output according to the invention is set forth in FIG. 4.

In operation, the user (or, more accurately, the parent or other guardian of the user, since the actual user will most probably be a young child) moves the electro-mechanical switch 64 on the back of the control box 62 to either Level I or Level II. The user then momentarily applies pressure to one of the speech-reactive body or head region contact points, thereby momentarily depressing the mechanical speech-activating switch under the skin covering that body part. If the pressure is applied to an area not precisely over the switch within the ears or the belly, the pressure is transferred to that switch through the switch cap covering the switch. As discussed below, activation of one of the mechanical switches closes an electrical circuit on the PCB 63 within the control box 62, thereby accessing the program and speech data embedded in the chip 6 and associated with that particular circuit, and resulting in that speech data being played over the speaker. For each contact point pressed, each associated electro-mechanical speech-activating switch depressed, and each connected electrical PCB circuit closed, different speech data will be accessed, depending on whether the level switch 64 is set to Level I or Level II. The doll 1 is also equipped within its PCB circuits 63 with a standard electronic "power up" feature that allows the doll 1 to be in an "off," or not powered, state when no switch has been activated and to be in an "on," or powered, state only from the time the mechanical switch has been activated until the time the associated speech has completed playing through the speaker.

For example, referring to FIG. 5, if the user presses on the right eye 32, electro-mechanical speech-activating switch 43 is momentarily depressed, closing electrical switch (gate) SW1 and thereby applying a ground potential to diode D1 and, in turn, resistor R4. As a result, transistors Q1 and Q2 are turned on in succession, applying to the upstream-current side of capacitor C3 a ground potential, which, because the voltage across capacitor C3 cannot change instantaneously, charges line 6 and the initialization pin of the microprocessor integrated circuit U1. Called the "power up" feature, this initializing, or awakening, of the microprocessor, which is normally at rest in the power-off position, powers-on the doll 1 and allows the microprocessor to immediately operate according to the particular program that is activated. When electrical switch (gate) SW1 is closed, a ground potential is applied also to line 4, which leads into input port PA0 and causes the microprocessor integrated circuit U1 to run the program associated with that input port and to output the associated data. The associated speech data related to the eye is output and converted by digital-/analog converters DA1 and DA2 to analog signals, which are then played over the speaker SP1. Depending on whether the level switch (electro-mechanical switch 64 in FIG. 2, electrical gate switch SW12A in FIG. 5) is set to Level I or Level II, a different eye-related speech phrase will be played. As the speech phrase is completed, the microprocessor, by way of line 6, is powered off. A process identical to the one just described occurs, i.e., the electrical switch SW2 closes and the same ground potentials are applied, if the user presses on the left eye 34 and momentarily depresses electro-mechanical speech-activating switch 44.

similarly, pressing on nose 40 activates electro-mechanical speech-activating switch 50 underneath, thereby closing electrical switch SW3. Closing electrical switch SW3 ultimately results, by way of associated diode D2, in powering-on of the doll 1 and in playing of the speech data associated with the nose, by the processes described above. Likewise, pressing on mouth 41 activates electro-mechanical speech-activating switch 51, thereby closing electrical switch SW4; pressing on ears 36,38 on the surrounding regions causes switch caps 47,49 to activate electro-mechanical switches 46,48, thereby closing electrical switches SW5,SW6, respectively; pressing on hands 24,26 activates electro-mechanical switches 52,54, thereby closing electrical switches SW7,SW8, respectively; pressing on feet 28,30 activates electro-mechanical switches 56,58, thereby closing electrical switches SW9,SW10, respectively; and pressing on belly 11 or the surrounding region causes switch cap 61 to activate electro-mechanical switch 60, thereby closing electrical switch SW11. As described above, closing of each of the electrical switches SW4–SW11 ultimately results, by way of the respectively associated diode D3–D7, in powering-on of the doll 1 and in playing of the speech data associated with the body or head region part pressed. Also, for each body part pressed, depending on whether electro-mechanical level switch 64 (and corresponding electrical level switch SW12A) is set to Level I or Level II, a different one of the phrases from the pair of phrases associated with that body part will be played.

The microprocessor integrated circuit within the doll of the present invention allows the speech phrases to be randomly accessed. Because the data for each speech phrase is within the memory of the microprocessor chip, which by its nature can be randomly accessed, a user can access any speech phrase desired in any order desired simply by moving the electro-mechanical level switch 64 to the desired level setting and pressing on the body part with which the desired speech phrase is associated. In addition, the user need not wait until the completion by the doll of a first phrase before a second phrase may be played. Because of the power-up feature of this invention, the microprocessor chip is powered on and initialized anew each time one of the electrical switches SW1–SW11 is closed; thus, regardless of the microprocessor program being run at the time, pressing on one of the speech-reactive body or head region parts closes the associated electrical switch and initializes the microprocessor to run the program and output the speech data that are each associated with that body part.

In further operation of the present invention, the user (or the parent or other guardian of the user) moves the electro-mechanical switch 64 on the back of the control box 62 to Level III (programmable identification mode). When the electrical switch SW12A on the PCB 63 is set to Level III, activation of any one of electrical switches SW1–SW11 will power-up the microprocessor into a program that temporarily stores in a memory buffer the data for whichever electrical switches SW1–SW11 are closed. Thus, when the user then momentarily applies pressure to a series (up to a particular number, preferably three) of the speech-reactive body or head region contact points, the series of electrical speech-activating switches on the PCB 63, which correspond to the contact points that were pressed, are closed in the same sequence. As in Levels I and II, closing of each electrical speech-activating switch SW1–SW11 in Level III ultimately results, by way of the associated diodes D1–D7, in the running of the program associated with that switch and in the output of the associated speech data. However, in Level III, rather than immediately outputting the speech data to the digital/analog converters and to the speakers, the microprocessor chip stores in a memory buffer the switch number for each switch closed, until the user indicates the end of the sequence (either by some positive action or by not pressing another speech-reactive body part for a predetermined time interval) or until the maximum number of speech-reactive body parts has been pressed. Then, once the end of the sequence has been indicated, the sequence recorded is output to the digital/analog converters DA1,DA2, where it is converted to analog signals and played over speaker SP1 in the same sequence in which the data was entered into memory, i.e., the same sequence in which the speech-reactive body parts were pressed.

Thus, a doll with programmable speech activated by pressure on particular contact points of the doll's head or body is provided. One skilled in the art will appreciate that the present invention can be practiced by other than the described embodiments, which are presented for purposes of illustration and not limitation, and the present invention is limited only by the claims that follow.

What is claimed is:

1. A talking doll capable of playing preprogrammed speech, comprising:

a housing in the form of a human infant body, said housing comprising a head having human facial and head features thereon including a nose and a mouth, which head is comprised of a head frame within said head and a flexible outer covering around said head frame forming said human features;

storage means mounted within said housing for storing a plurality of prerecorded audible speech messages;

speaker means mounted within said housing for playing said prerecorded audible speech messages;

a plurality of switches set at various points within said housing, each switch being respectively associated with a different group of audible speech messages from among the plurality of prerecorded audible speech messages, at least two of said plurality of switches being set within said head frame whereby each of said at least two switches is associated with one of said features, such that a first of said at least two switches is associated with said nose and with a first group of said audible speech messages concerning said nose, a second of said at least two switches is associated with said mouth and with a second group of said audible speech messages concerning said mouth, and said first and second of said at least two switches are in close proximity to one another; and processor control means mounted within said housing and coupled to each of said storage means, speaker means and switches, and having a stored program of coded instructions, including (a) means for operating said doll in a first mode in which activation of each of said switches from within said plurality of switches causes a respective one of said audible speech messages from a first set of said prerecorded audible speech messages to be played through said speaker means;

(b) means for operating said doll in a second mode in which activation of each of said switches from within said plurality of switches causes a respective one of said audible speech messages from a second set of said prerecorded audible speech messages to be played through said speaker means; and (c) means for operating said doll in a third mode in which activation of a succession of at least one of said switches from within said plurality of switches causes a succession of respective ones of said audible speech messages from a first set of prerecorded audible speech messages to be played through said speaker means;

wherein said housing further comprises a protrusion within said head frame between said first switch associated with said nose and said second switch associated with said mouth, whereby said protrusion prevents activation of either of said first and second switches when the other of said first and second switches is activated.

2. The talking doll of claim 1, further comprising a mode switch means for changing among said first, second and third modes of operation.

3. The talking doll of claim 1, wherein said housing further comprises a two arms, two legs and a body section.

4. The talking doll of claim 1, wherein each of said switches from within said plurality of switches is associated with a part of said human infant body of said housing; and wherein said first set of audible speech messages identify parts of said human infant body; and wherein activation of each of said switches in said first mode causes a respective one of said audible speech messages identifying the part of said human infant body with which said switch is associated.

5. The talking doll of claim 1, wherein each of said switches from within said plurality of switches is associated with a part of said human infant body of said housing; and wherein said second set of audible speech messages concern functions involving parts of the human body; and wherein activation of each of said switches in said second mode causes a respective one of said audible speech messages concerning the function of said human infant body with which said switch is associated.

* * * * *